United States Patent [19]

Babson et al.

[11] Patent Number: 4,825,787

[45] Date of Patent: May 2, 1989

[54] METHOD AND APPARATUS FOR GUIDING FABRIC TO A SEWING MACHINE

[75] Inventors: Edward Babson, Ipswich; Thomas G. Brophy, Gloucester; Steven Marcangelo, Chelmsford, all of Mass.

[73] Assignee: Porter Sewing Machines, Inc., Beverly, Mass.

[21] Appl. No.: 52,577

[22] Filed: May 20, 1987

[51] Int. Cl.[4] ..... D05B 27/14; D05B 35/10

[52] U.S. Cl. ..... 112/262.3; 112/306; 112/153

[58] Field of Search ..... 112/306, 308, 309, 153, 112/121.11, 136, 318, 262.3, 262.1

[56] References Cited

U.S. PATENT DOCUMENTS

| | | | |
|---|---|---|---|
| 3,417,718 | 12/1968 | Andersson | 112/153 |
| 3,970,014 | 7/1976 | Chano et al. | 112/153 X |
| 3,986,467 | 10/1976 | Hornkohl | 112/153 X |
| 4,126,097 | 11/1978 | Willenbacher | 112/153 |
| 4,292,908 | 10/1981 | Blessing | 112/306 |

*Primary Examiner*—Peter Nerbun

*Attorney, Agent, or Firm*—Wolf, Greenfield & Sacks

[57] ABSTRACT

Method and apparatus for aligning fabric as it is advanced in a prescribed direction toward a sewing machine such as a double overlock seamer for stitching pants. Photosensitive devices sense displacement of edges of upper and lower fabric plies relative to a desired alignment line. Error signals are produced when either ply edge is displaced from the desired alignment line. Friction wheels responsive to the respective error signals guide each ply toward the desired alignment line as it is advanced toward the sewing machine. Each friction wheel pivots about an axis perpendicular to the ply and is controlled by a stepper motor. Each friction wheel is movable between an operating position in which it is biased against the respective fabric ply, and a retracted position for insertion or removal of fabric. The pressure applied to the fabric ply by the friction wheel is adjustable. A centering device aligns each friction wheel with the direction of fabric movement toward the sewing machine when no fabric is present in the apparatus.

27 Claims, 8 Drawing Sheets

68
168
170
164
152
64
162
136
160
134
132
154
150
154
136
140
144
172
112
94
84
110
108
96
62
60
102
104
114
182
190
40
42
66
226
228
220
222
48
66
78
46
30
44
36
34
38
50
32
52
54
106
14
16

METHOD AND APPARATUS FOR GUIDING FABRIC TO A SEWING MACHINE

FIELD OF THE INVENTION

This invention relates to methods and apparatus for automatically aligning fabric prior to stitching in a sewing machine and, more particularly, to methods and apparatus for automatically aligning upper and lower plies prior to stitching in a double overlock seamer.

BACKGROUND OF THE INVENTION

A sewing machine for performing twin overedging and seaming in one high-speed operation is disclosed in U.S. Pat. No. 4,546,716 (Babson et al) issued Oct. 15, 1985 and assigned to the assignee of the present application. The disclosed double overlock seamer is used for stitching the legs of a pair of pants or a skirt. It stitches the seam and overedges the free edge of each ply in a single operation.

The two fabric plies of a pant leg that are fed to the sewing machine for stitching are normally maintained in alignment by the operator. They must be maintained in alignment not only with each other, but also with the sewing machine workstation to produce satisfactory results. When the fabric becomes misaligned, it is necessary for the operator to temporarily stop the machine and correct the alignment. Such stoppage is, of course, undesirable from a productivity viewpoint. Furthermore, it is not always easy to determine exact alignment visually because the edge of the lower ply may be hidden under the upper ply. A further difficulty arises from the fact that the upper and lower plies of a pant leg do not necessarily have the same width. When this occurs, alignment of the upper and lower plies becomes even more difficult, particularly after one side of the pant leg has been stitched. The wider ply must then be bunched up in order to align the plies for stitching of the other side.

It is a general object of the present invention to provide methods and apparatus for automatically aligning fabric with a sewing machine workstation.

It is another object of the present invention to provide methods and apparatus for automatically aligning upper and lower fabric plies with each other and with a sewing machine workstation.

It is a further object of the present invention to provide methods and apparatus for sensing displacement of a fabric edge from a desired alignment line and for guiding the fabric edge toward the desired alignment line as it is advanced toward a sewing machine.

It is still another object of the present invention to provide methods and apparatus for automatically aligning fabric with a sewing machine which are low in cost and easy to operate.

SUMMARY OF THE INVENTION

According to the present invention, these and other objects and advantages are achieved in apparatus for use with a sewing machine wherein a fabric ply is moved in a prescribed direction toward the sewing machine. The apparatus comprises sensing means for sensing displacement, in a direction lateral to the prescribed direction of movement, of an edge of a ply relative to a desired alignment line, feedback means responsive to the sensing means for providing an error signal when the ply edge is displaced from the desired alignment line and ply guide means responsive to the error signal for guiding the ply toward the desired alignment line as it is advanced toward the sewing machine.

In a preferred embodiment, apparatus for aligning an upper ply and a lower ply moving in a prescribed direction prior to stitching by a sewing machine comprises upper sensing means for sensing displacement, in a direction lateral to the prescribed direction of movement, of an edge of the upper ply relative to a desired upper alignment line, upper feedback means responsive to the upper sensing means for providing an upper error signal when the upper ply edge is displaced from the desired upper alignment line, upper ply guide means responsive to the upper error signal for guiding the upper ply toward the desired upper alignment line as it is advanced toward the sewing machine, lower sensing means for sensing displacement, in a direction lateral to the prescribed direction of movement, of an edge of the lower ply relative to a desired lower alignment line, lower feedback means responsive to the lower sensing means for providing a lower error signal when the lower ply edge is displaced from the desired lower alignment line and lower ply guide means responsive to the lower error signal for guiding the lower ply toward the desired lower alignment line as it is advanced toward the sewing machine. Usually, the desired upper alignment line and the desired lower alignment line are the same.

Each edge sensing means can comprise a light source mounted on one side of the ply and a photosensor mounted on the opposite side of the ply, the light source being positioned to direct a light beam across the edge of the ply at the photosensor. The photosensor can comprise a linear photosensitive array mounted across a desired alignment line so that the amount of light from the light source which reaches the photosensor, and the corresponding output of the photosensor, depend on the displacement of the ply edge from the desired alignment line.

Each ply guide means can comprise a friction wheel positioned on one side of the ply and a guide surface positioned on the opposite side of the ply. The friction wheel rotates about an axis parallel to the ply and pivots about an axis perpendicular to the ply for guiding the ply. The friction wheel and the surface are positioned to frictionally grip the ply therebetween. The ply guide means further includes drive means responsive to the error signal for pivoting the friction wheel about the perpendicular axis so as to guide the ply toward the desired alignment line. The drive means can comprise a stepper motor responsive to the error signal and timing belt means coupling the stepper motor to the friction wheel for pivoting about the perpendicular axis.

The apparatus further includes a support arm for supporting each friction wheel and means coupling each support arm to a fixed table. Each support arm can be spring-biased to urge the friction wheel against the respective ply. The apparatus can include retraction means for moving each friction wheel between an operating position in which the friction wheel bears against the ply and a retracted position for insertion or removal of the ply. The apparatus can further include centering means for aligning each friction wheel with the prescribed direction of movement when no ply is present.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1A:
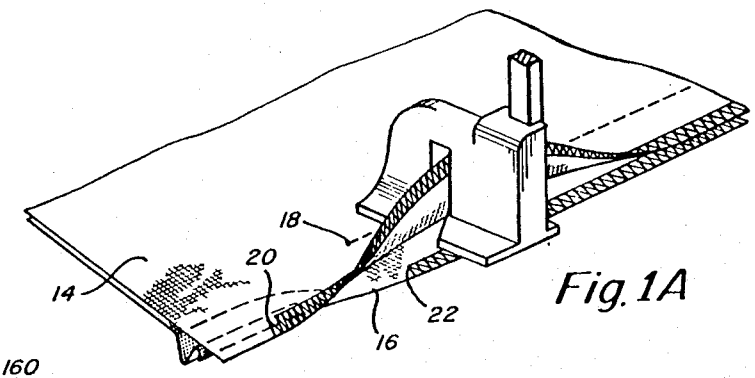
FIG. 1A is a perspective view illustrating the twin overedging and seaming operation performed by the sewing machine of FIG. 1.
Figure 1:
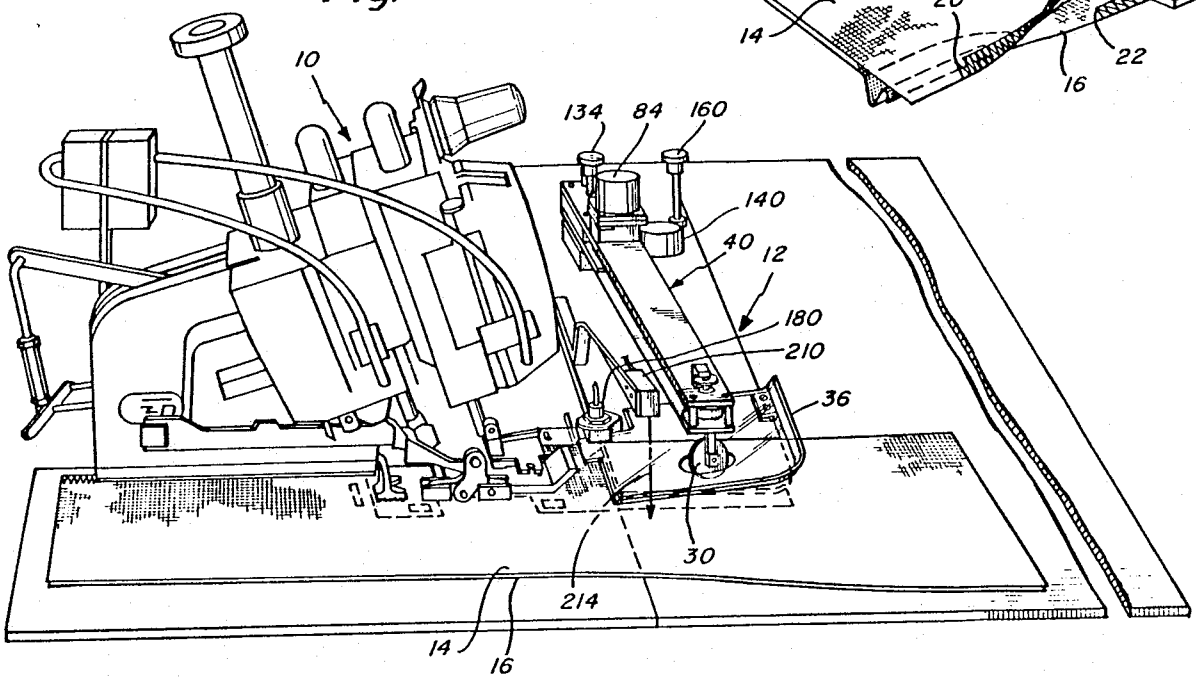
FIG. 1 is a perspective view of a sewing machine and fabric alignment apparatus in accordance with the present invention.
Figure 2:
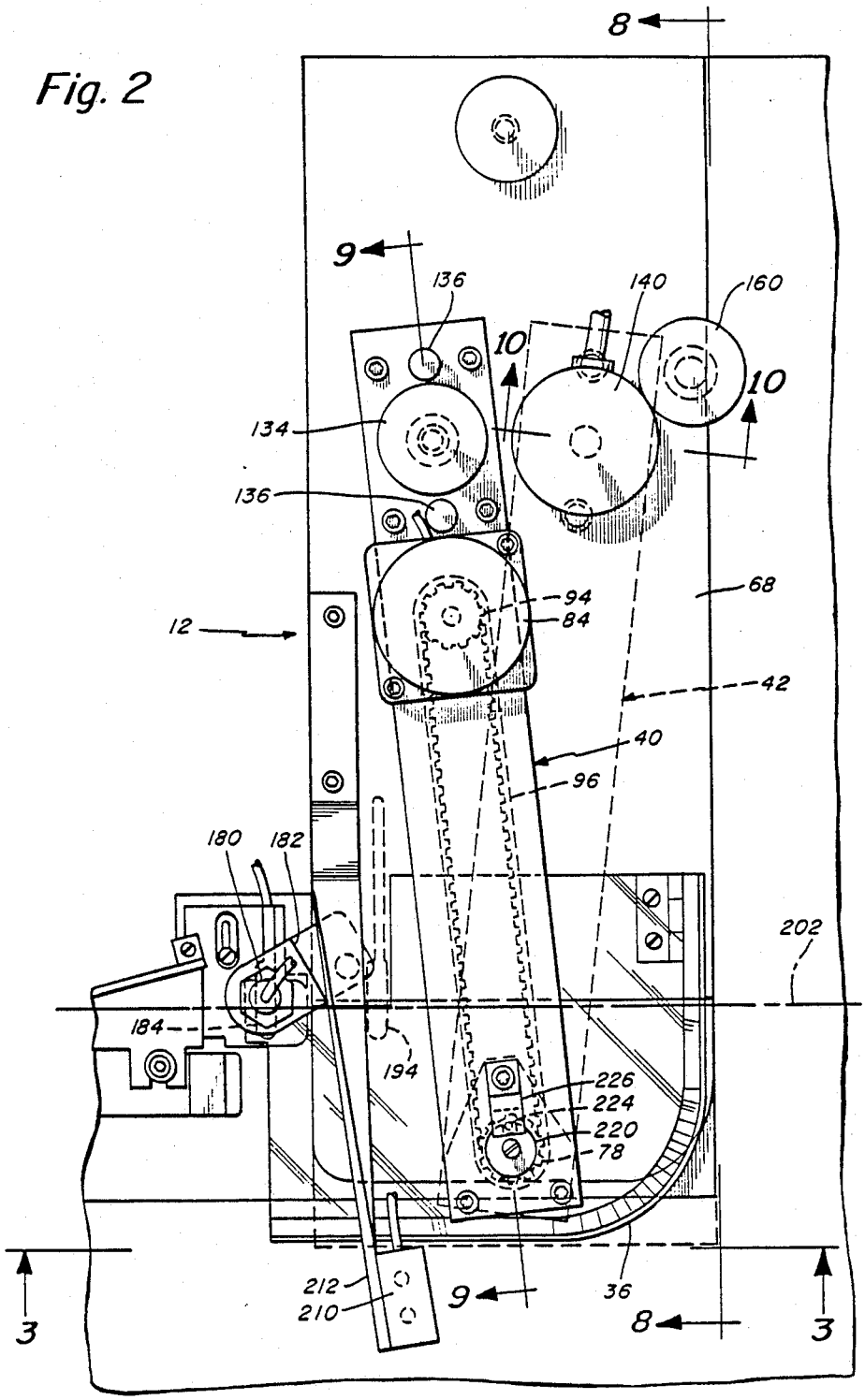
FIG. 2 is a plan view of the alignment apparatus of the present invention.
Figure 4:
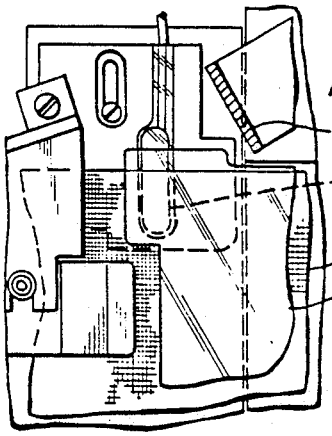
FIG. 4 is a partial plan view of the alignment apparatus showing the location of the upper ply photosensor and is taken along the line 4—4 of FIG. 3.

A sewing machine 10 and alignment apparatus 12 in accordance with the present invention are illustrated in FIG. 1. The sewing machine 10 can be adapted for performing twin overedging and seaming in one high speed operation as described in U.S. Pat. No. 4,546,716, which is hereby incorporated by reference. The basic operations of the sewing machine 10 are illustrated schematically in FIG. 1A. A pants leg including an upper ply 14 and a lower ply 16 are stitched at position 18 to form a seam. Overedge stitching of the upper ply 14 occurs at position 20 and overedge stitching of the lower ply 16 occurs at position 22. Thus, the stitching operation is completed in one pass.

The fabric guiding or alignment apparatus 12 of the present invention performs the function of automatically guiding the upper and lower plies into the sewing machine in alignment with each other and in alignment with the stitching station of the sewing machine 10. The alignment apparatus 12 operates by sensing the displacement of each ply from a desired alignment line and using the sensed displacement information to individually control friction wheels which are biased against the upper and lower plies and which guide the respective plies toward the desired alignment line.

Figure 3:
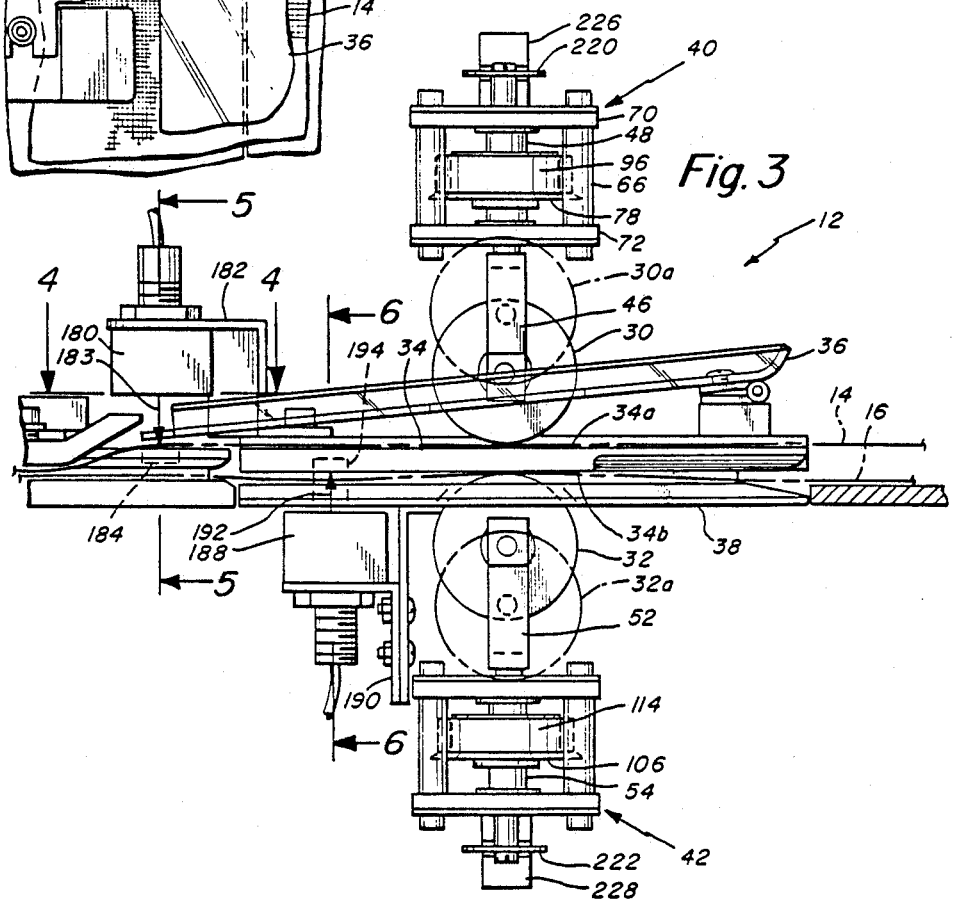
FIG. 3 is an elevation view of the alignment apparatus of the present invention taken along the line 3—3 of FIG. 2.
Figure 8:
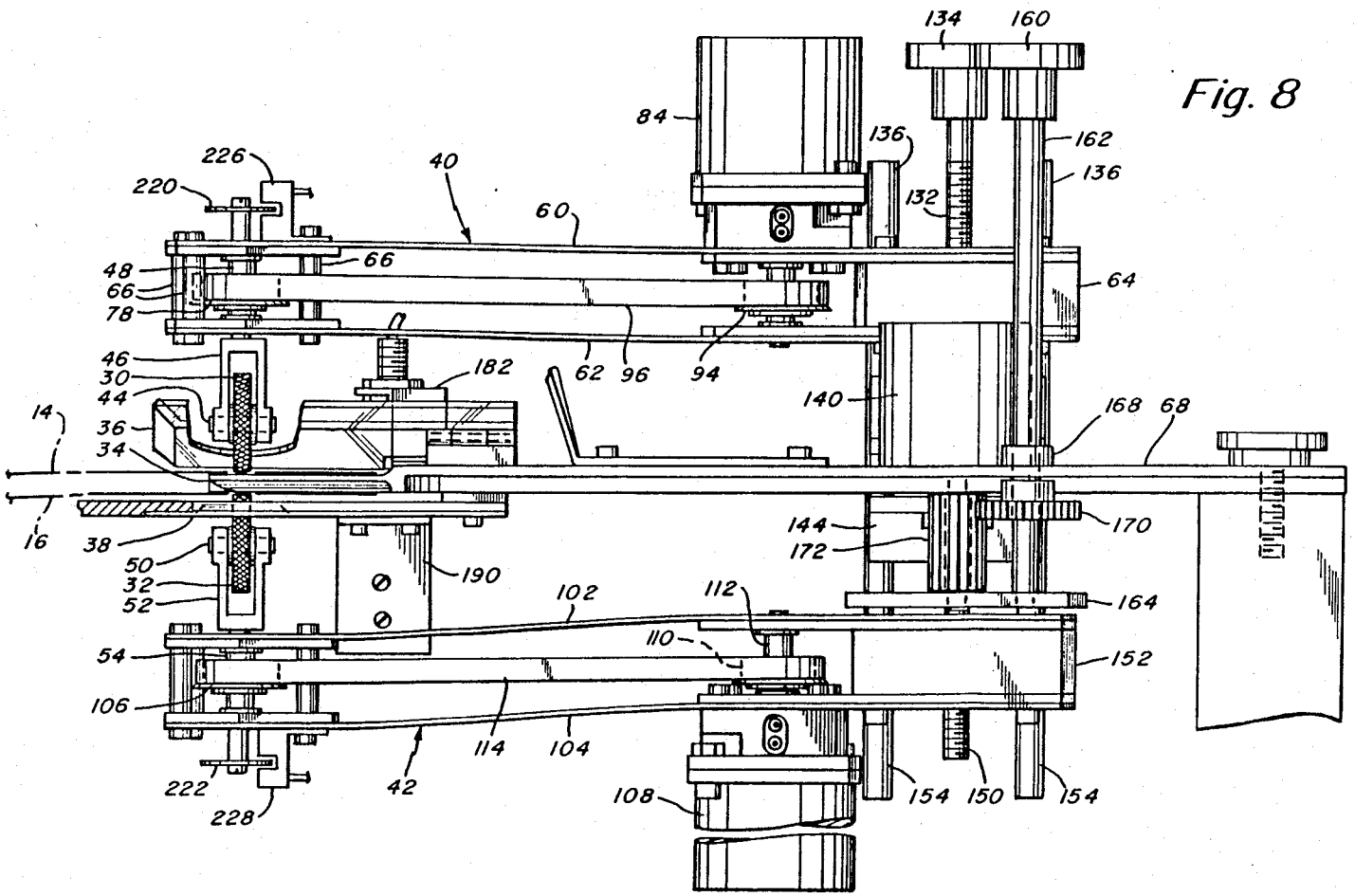
FIG. 8 is an elevation view of the alignment apparatus of the invention taken along the line 8—8 of FIG. 2.

Friction wheels 30 and 32, as best shown in FIGS. 3 and 8, are used for guiding the upper ply 14 and the lower ply 16, respectively. The upper ply 14 passes above a guide plate 34 between an upper plate 36 and the guide plate 34 as it moves toward the sewing machine 10. The lower ply 16 passes below the guide plate 34 between a lower plate 38 and the guide plate 34. The upper friction wheel 30 is carried by an upper support arm 40 which urges friction wheel 30 against an upper surface **34*a* of guide plate 34 with upper ply 14 sandwiched therebetween. The lower friction wheel 32 is carried by a lower support arm 42 which urges friction wheel 32 against a lower surface 34*b* of guide plate 34 with lower ply 16 sandwiched therebetween. The friction wheels 30 and 32 are retractable to positions 30*a* and 32*a*, respectively, as shown in FIG. 3**, to permit insertion and removal of fabric.

The upper friction wheel 30 is mounted for rotation about a pivot pin 44 parallel to the upper ply 14 and attached at opposite ends to a generally U-shaped yoke 46. The yoke 46 is attached to support arm 40 by a shaft 48 perpendicular to upper ply 14 to permit pivoting of the friction wheel 30. The friction wheel 30 rotates freely about pivot pin 44. Pivoting about shaft 48 is controlled as described in detail hereinafter to guide the upper ply 14. The lower friction wheel 32 is supported for rotation about a pivot pin 50 parallel to lower ply 16 and attached at opposite ends to a generally U-shaped yoke 52. The yoke 52 is coupled to lower support arm 42 by a shaft 54 perpendicular to lower ply 16. Friction wheel 32 rotates freely about pivot pin 50 and pivots about shaft 54 for guiding lower ply 16 as described in detail hereinafter. The circumferential edges of the friction wheels 30 and 32 can be knurled or otherwise roughened to improve frictional contact with plies 14, 16.

Figure 9:
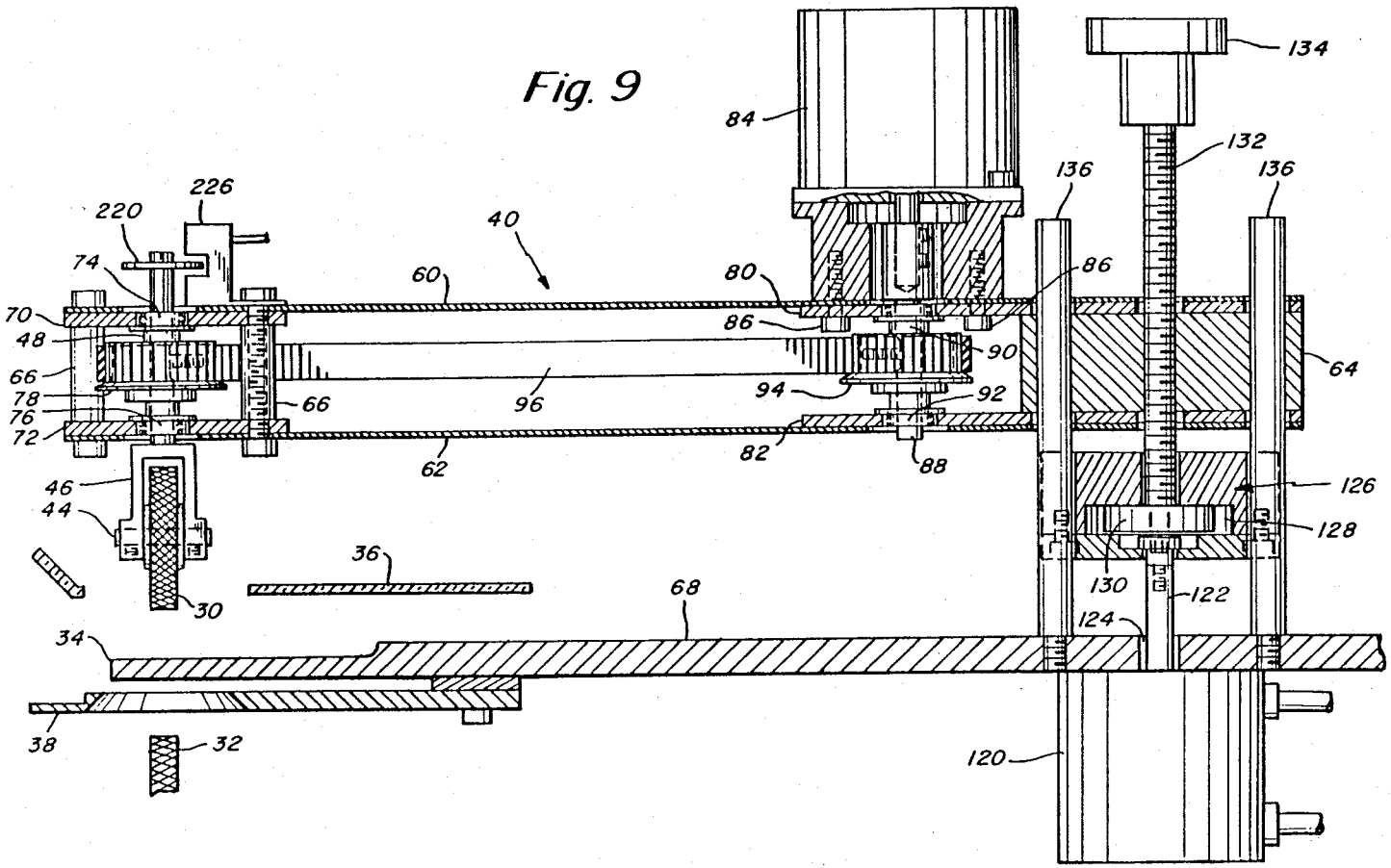
FIG. 9 is a cross-sectional elevation view of the alignment apparatus of the invention taken along the line 9—9 of FIG. 2.

A cross-sectional view of upper support arm 40 is shown in FIG. 9 in order to illustrate the detailed construction of the support arm. A pair of elongated flat strips 60, 62 are spaced apart at one end by a spacer block 64 and are spaced apart at the other end by spacer pins 66. The arm 40 is supported at the spacer block 64 end above a table 68 as described in detail hereinafter. The strips 60, 62 are preferably spring steel to permit flexing of the arm as best illustrated in FIG. 8.

At the end of support arm 40 to which friction wheel 30 is connected, a stiffening plate 70 is attached to strip 60 and a stiffening plate 72 is attached to strip 62. Stiffening plates 70, 72 are held in position by the spacer pins 66. The shaft 48, which supports yoke 46 and friction wheel 30, is mounted to stiffening plate 70 by a bearing 74 and is mounted to stiffening plate 72 by a bearing 76. A timing gear 78 is attached to shaft 48 between bearings 74 and 76.

A stiffening plate 80 is mounted between spacer block 64 and strip 60 and extends partway toward the other end of arm 40. A stiffening plate 82 is mounted between spacer block 64 and strip 62 and extends partway toward the other end of arm 40. A stepper motor 84 is mounted to the support arm 40 by machine screws 86 which pass through stiffening plate 80 and strip 60 into the stepper motor 84. A conventional motor shaft extension 88 is coupled to the shaft of stepper motor 84. The shaft extension 88 is mounted to stiffening plate 80 by a bearing 90 and is mounted to stiffening plate 82 by a bearing 92. A timing gear 94 is attached to shaft extension 88 between bearings 90 and 92. A timing belt 96 couples timing gear 94 to timing gear 78. When the stepper motor 84 is energized, the friction wheel 30 is caused to pivot about vertical shaft 48.

The lower support arm 42 is constructed generally the same as upper support arm 40 except for differences in the tension adjustment mechanism as described hereinafter. The lower support arm 42 includes upper and lower strips 102, 104 of spring steel supporting the friction wheel 32. The shaft 54, which is attached through yoke 52 to friction wheel 32, has a timing gear 106 attached to it. A stepper motor 108 is mounted to lower strip 104 and has a shaft extension 112 attached to its shaft. A timing gear 110 is attached to shaft extension 112. The timing gears 106, 110 are connected by a timing belt 114. Since the lower support arm 42 is the same as the upper support arm 40, further details of its construction are omitted. When the stepper motor 108 is energized, the friction wheel 32 is caused to pivot about shaft 54.

As noted above, each of the support arms 40, 42 is movable between an operating position in which the respective friction wheel 30, 32 bears against guide plate 34, and a retracted position (FIG. 9) which permits fabric to be loaded into, or removed from, the apparatus. During normal operation, the upper ply 14 and the lower ply 16 are drawn through the sewing machine 10 and do not require manual removal. However, retraction of the support arms 40, 42 is required to load new fabric and to remove fabric in the case of any difficulties with the machine or with the fabric. Each of the support arms 40, 42 is moved between the operating position and the retracted position by an air cylinder.

With reference to FIG. 9, upper support arm 40 is raised and lowered by an air cylinder 120 mounted on the underside of table 68. An air cylinder piston 122 passes through an opening 124 in table 68 and is connected to an adjustment block 126. The adjustment block 126 includes an internal cavity 128 containing a shoulder 130 attached to a threaded adjustment pin 132. The adjustment pin 132 extends upwardly through the top of adjustment block 126 and through a threaded bore in spacer block 64, and has an adjustment knob 134 at its upper end. A pair of guide pins 136 are mounted vertically on table 68 and extend through guide holes in support arm 40.

In order to raise support arm 40 to the retracted position, air cylinder 120 is activated by a suitable air pressure, causing piston 122 to move upwardly by approximately one-half inch. The piston 122, adjustment block 126, adjustment pin 132 and support arm 40 move upwardly as a unit. The support arm 40 slides on guide pins 136 which mechanically stabilize arm 40.

The tension, or pressure, adjustment arrangement, including adjustment block 126, shoulder 130, adjustment pin 132 and adjustment knob 134, permit the vertical position of the support arm 40 to be adjusted even though the travel provided by air cylinder 120 is fixed. As a result, the pressure between friction wheel 30 and guide plate 34 in the operating position can be carefully controlled so that the fabric is guided in the desired manner without restricting its movement. The shoulder 130 is free to rotate with adjustment pin 132 in cavity 128. Since adjustment block 126 is attached to piston 122, its vertical position is established by piston 122. As adjustment knob 134 is turned, the shoulder 130 rotates in cavity 128 and the lower end of adjustment pin 132 remains in a fixed vertical position. Thus, support arm 40, which is attached to adjustment pin 132 by means of the threaded bore through spacer block 64, is raised or lowered as adjustment knob 134 is turned.

The lower support arm 42 is raised and lowered by a similar arrangement. An air cylinder 140 (FIG. 8) is mounted on the top surface of table 68 and is connected through the table 68 to support arm 42. When the air cylinder 140 is activated, support arm 42 and friction wheel 32 are lifted from guide plate 34 to permit loading or removal of fabric.

Figure 10:
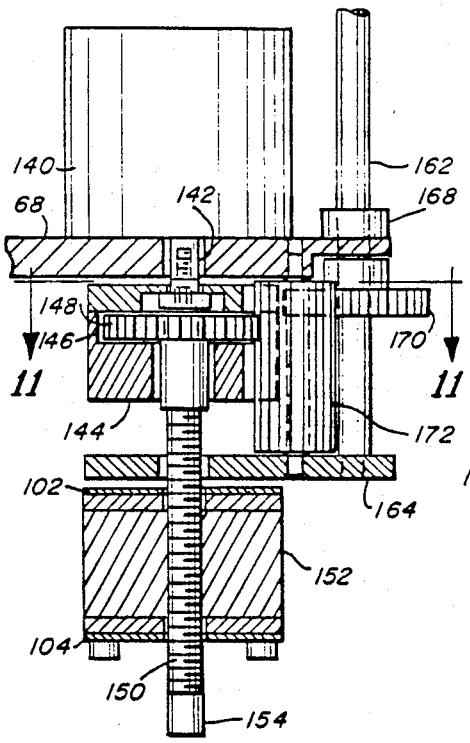
FIG. 10 is a partial elevation view, partly in cross-section, of the adjustment mechanism for the lower arm taken through the line 10—10 of FIG. 2.
Figure 11:
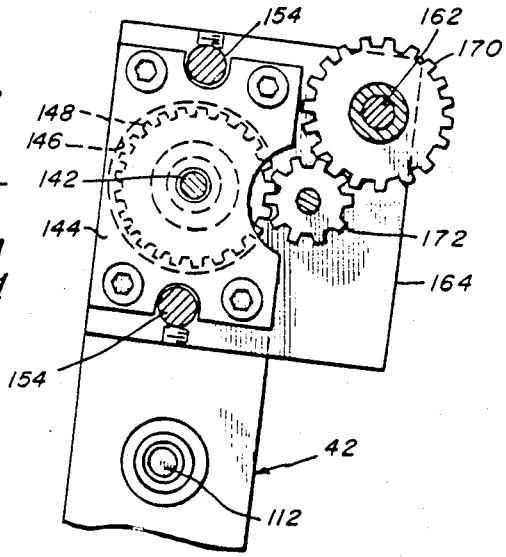
FIG. 11 is a plan view of the adjustment mechanism for the lower arm taken through the line 11—11 of FIG. 10.

The arrangement for adjusting the pressure on the lower support arm 42 is different from the arrangement on the upper support arm 40 in order to place the lower support arm tension adjustment knob on the upper surface of table 68 where it is accessible to the operator. The details of the lower arm adjustment arrangement are illustrated in FIGS. 10 and 11. A piston 142 of air cylinder 140 passes through a hole in table 68 and is connected to an adjustment block 144. The adjustment block 144 includes a cavity 146 containing a gear 148. The gear 148 is attached to an upper end of a threaded pin 150. The threaded pin 150 extends downwardly through the bottom of adjustment block 144 and through a threaded bore in a spacer block 152. The spacer block 152 is mounted between strips 102, 104 of lower support arm 42 and corresponds to spacer block 64 of upper support arm 40. Thus, when the air cylinder 140 is actuated, piston 142, adjustment block 144, threaded pin 150 and lower support arm 42 all move up or down together. Guide pins 154 (FIG. 8) are attached to table 68 and pass through holes in spacer block 152 so as to stabilize the lower support arm 42 and for mounting of support plate 164.

Adjustment of the lower support arm 42 is described with reference to FIGS. 8, 10 and 11. A lower adjustment knob 160 and an adjustment pin 162 are vertically mounted on table 68. A support plate 164 is mounted below the table 68 and spaced therefrom. The adjustment pin 162 passes through a collar 168 fixed to pin 162, through a hole in Table 68 and through a hole in support plate 164 so that pin 162 is supported vertically and can rotate. Referring now to FIGS. 10 and 11, a drive gear 170 is fixed to adjustment pin 162 between table 68 and mounting plate 164. An elongated pinion gear 172 is mounted between table 68 and support plate 164 so as to mesh with gear 148 and with drive gear 170. When adjustment knob 160 is turned, the drive gear 170 and pinion gear 172 cause gear 148 and threaded pin 150 to turn. The vertical position of threaded pin 150 is established by its attachment to gear 148 and adjustment block 144. The turning of pin 150 causes lower support arm 42 to move up or down, since it is threaded onto pin 150. The elongated pinion gear 172 permits the gears 148, 172 and 170 to remain meshed as air cylinder 140 moves adjustment block 144 up and down. The three-gear arrangement permits the upper and lower adjustment knobs 134, 160 to be turned in the same direction for a prescribed raising or lowering of the respective support arms 40, 42.

The apparatus of the present invention further includes means for sensing the alignment of the upper ply 14 and the lower ply 16 and providing signals that control pivoting of the friction wheels 30, 32, which guide the upper and lower plies toward a desired alignment line. The sensing means operates by sensing the displacement of each ply edge from the desired alignment line. In a preferred embodiment, the sensor includes a light source and photosensor combination which senses the edge of each ply. Referring to FIG. 3, the sensing means for upper ply 14 includes a light source 180, mounted by a bracket 182 to table 68. The light source 180 is mounted above upper ply 14 and directs a light beam 183 downwardly across the edge of upper ply 14. A photosensor 184 is mounted in a guide plate under upper ply 14 in alignment with light beam 183. Similarly, the sensing means for the lower ply 16 includes a light source 188 mounted by a bracket 190 below upper ply 16 so as to direct a light beam 192 upwardly at upper ply 16. A photosensor 194 is mounted in guide plate 34 above lower ply 16 in alignment with light beam 192.

Figure 7:
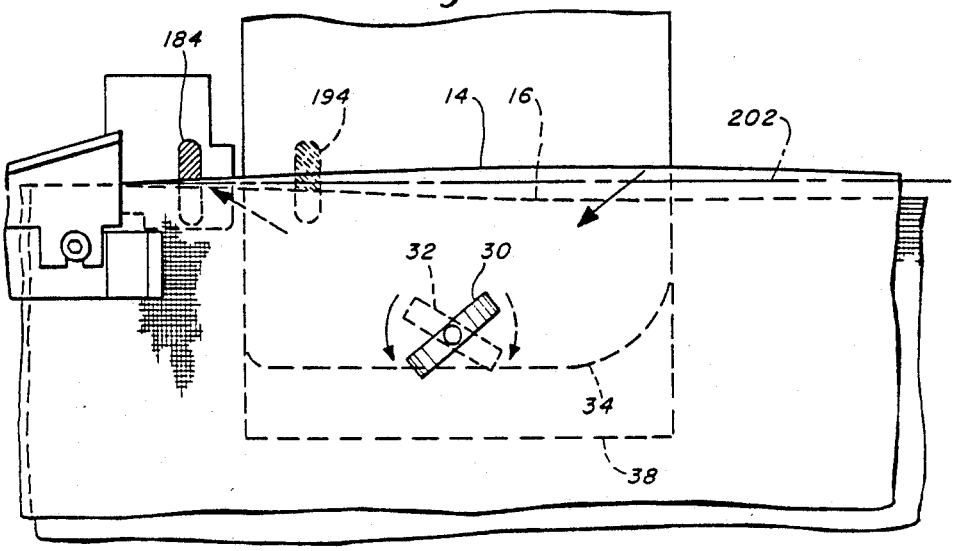
FIG. 7 is a schematic plan view of the alignment apparatus illustrating the alignment technique of the present invention.

The basic operation of each light source and photosensor combination is illustrated with reference to FIG. 7. A desired alignment line 202 is established for proper operation of the sewing machine, and it is desired that the upper ply 14 and the lower ply 16 both have their edges aligned with the line 202 as they enter the sewing machine 10. The photosensors 184, 194 are elongated in a direction perpendicular to the alignment line 202 and are positioned to straddle the alignment line 202. Preferably, the alignment line 202 passes through the center of each photosensor 184, 194 as shown in FIG. 7. When each ply is perfectly aligned along alignment line 202, one-half of each photosensor 184, 194 is covered and a prescribed output level is provided. When either of the plies 14, 16 is displaced from the alignment line 202, the proportion of the respective photosensor which is covered increases or decreases, causing a variation in the photosensor output.

In the example of FIG. 7, upper ply 14 is displaced upwardly from alignment line 202 and more of photosensor 184 is covered than in the case of perfect alignment. Thus, the current provided by photosensor 184 is decreased. This decreased current is used to energize stepper motor 84 and to pivot upper friction wheel 30 as described hereinafter so as to guide ply 14 toward alignment line 202. Similarly, lower ply 16 is displaced downwardly from alignment line 202 and less of photosensor 194 is covered than in the case of perfect alignment. The increase in light reaching photosensor 194 causes an increase in its output current. This current increase is used to energize stepper motor 108 and to pivot lower friction wheel 32 as described hereinafter so as to guide ply 16 toward alignment line 202.

Figure 13:
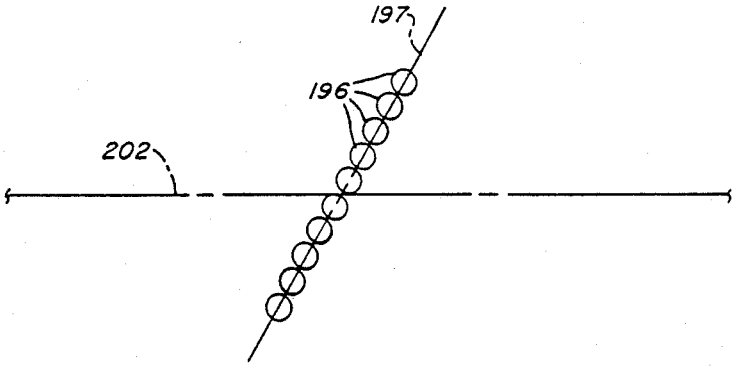
FIG. 13 is a schematic diagram of a preferred photosensor configuration in accordance with the present invention.

The photosensors 184, 194 can be any suitable light-sensing device such as a linear array of photodetectors or a series of individual photosensors mounted in a line. The photosensors can be mounted at an angle to alignment line 202 to provide continuous sensing without gaps therebetween, if so desired. Preferably, the light sources 180, 188 and the photosensors 184, 194 operate in the infrared portion of the spectrum in order to eliminate problems caused by ambient light in the visible portion of the spectrum. In a preferred embodiment illustrated in FIG. 13, each of the photosensors 184, 194 comprises a linear array of ten infrared-sensitive photodetectors 196 positioned along a line 197. The alignment line 202 passes through the center of the array of photodetectors 196 at an angle to avoid possible gaps in coverage between photodetectors 196. The photodetectors 196 are activated by a parallel linear array of ten infrared emitting diodes (not shown) aligned with photodetectors 196. The number of photodetectors 196 which is covered or uncovered by the fabric determines the deflection or pivoting of the respective friction wheel. When all photodetectors 196 are covered, the friction wheel is pivoted by approximately fifteen degrees in one direction, and when all photodetectors 196 are uncovered, the friction wheel is pivoted approximately fifteen degrees in the opposite direction. The outputs of photodetectors 196 can be summed into a single output or can be separately provided to a digital processing circuit.

The alignment apparatus of the invention further includes a fabric sensor comprising a photoemitter and photosensor device 210 (FIGS. 1 and 3) mounted adjacent the upper support arm 40 by means of a bracket 212. The device 210 includes a light source and a photodetector which can detect a reflected light beam 214 generated by the source. The device 210 is positioned above the apparatus and is directed downwardly so that, when fabric is present, the light beam 214 is diffused by the relatively rough fabric surface and relatively little of the beam is reflected. When no fabric is present, the light beam 214 reflects off the shiny surface of the table 68 and is sensed by the photodetector. As a result, the photosensor 210 can detect whether or not fabric is present in the machine.

The alignment apparatus further includes centering devices attached to the upper and lower support arms 40, 42. With reference to FIG. 8, an opaque disk 220 is attached to shaft 48 and an opaque disk 222 is attached to shaft 54. Each of the disks 220, 222 includes a radial slot 224 or a hole at one circumferential position. A photosensing device 226 is mounted to arm 40 so as to detect the slot in disk 220 and a photosensing device 228 is mounted to arm 42 so as to detect the slot 224 in disk 222. Each of the photosensing devices 226, 228 comprise a light source and a photodetector mounted at opposite ends of a C-shaped bracket. When an opaque object passes through the C-shaped bracket between the light source and the photodetector, the light beam normally striking the photodetector is broken. Thus, as pivot pin 48 rotates, the beam is normally broken by opaque disk 220 except at the slot 224. When the beam passes through slot 224 and strikes the photodetector, an output signal is provided. The photosensing device 228 operates in the same manner. The respective friction wheels 30, 32 are aligned with the direction of fabric movement toward the sewing machine 10 when the slots 224 are directly aligned with the photosensing devices 226, 228. Output signals are thus provided by devices 226, 228 when the respective friction wheel 30, 32 is aligned parallel to the direction of fabric movement toward the sewing machine 10.

Figure 12:
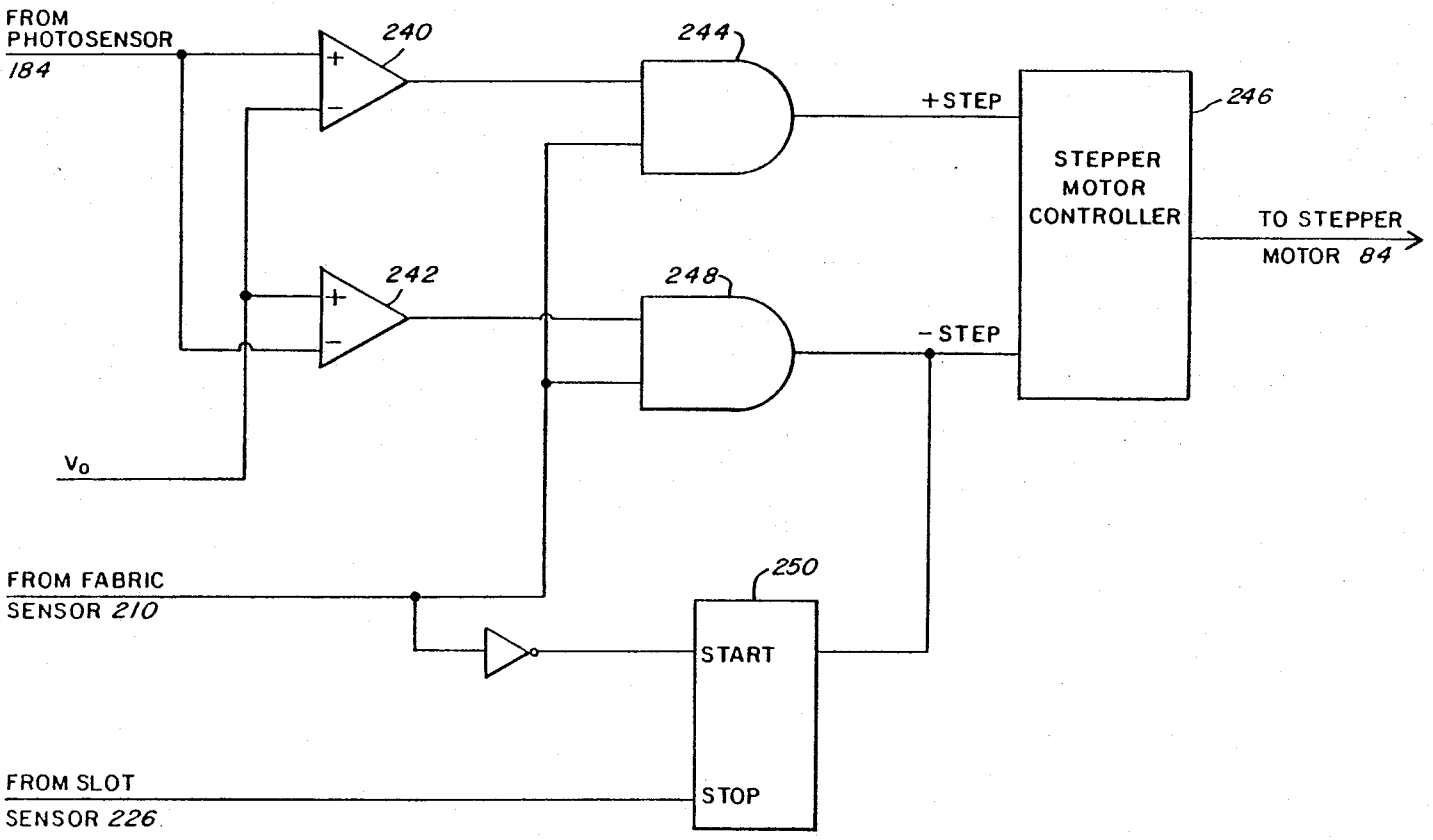
FIG. 12 is a schematic diagram of the feedback circuit for controlling the upper friction wheel in the alignment apparatus of the present invention.

A simplified block diagram of a feedback circuit for controlling stepper motors 84, 108 is shown in FIG. 12. The control of upper friction wheel 30 by photosensor 184 is described. It will be understood that lower friction wheel 32 is controlled in the same manner by photosensor 194 and by a separate but identical feedback circuit. The output signal from photosensor 184 is provided to a pair of comparators 240, 242. Each comparator 240, 242 compares the photosensor signal with a reference voltage $V_o$ which represents perfect alignment between the upper ply 14 and alignment line 202. As noted above, the photosensor 184 provides a prescribed signal $V_o$ when the upper ply 14 is aligned with the alignment line 202. When the upper ply 14 is displaced to the left or right of the alignment line 202, the photosensor 184 output is correspondingly increased or decreased. The comparator 240 senses an increased voltage, while the comparator 242 senses a decreased output voltage. When the photosensor 184 output increases due to displacement of the upper ply 14, comparator 240 provides an output signal through a gate 244 to a stepper motor controller 246, causing it to advance stepper motor 84 in one direction. Similarly, when the photosensor 184 output decreases due to a displacement of the upper ply 14 in the opposite direction, the comparator 242 provides an output through a gate 248 to the stepper motor controller 246, causing it to advance the stepper motor 84 in the opposite direction. As described above, stepper motor 84 causes friction wheel 30 to pivot about shaft 48. The pivoting, or turning, of friction wheel 30, in turn, guides the upper ply toward the alignment line 202.

The gates 244, 248 are controlled by the signal from the fabric photosensor 210. As long as the photosensor 210 senses that fabric is present in the apparatus, the gates 244, 248 are enabled and the signals from the photosensor 184 are enabled to control stepper motor 84. When no fabric is present in the system, the gates 244, 248 are inhibited so that the system does not attempt to guide fabric when none is present. The fabric sensor signal is also provided to a start/stop circuit 250 such as a flip-flop which is utilized to center each of the friction wheels 30, 32 when no fabric is present in the system. The output of start/stop circuit 250 is connected to one of the inputs of the stepper motor controller 246. When the fabric sensor signal indicates that no fabric is present in the apparatus, the start/stop circuit 250 is set, causing a signal to be sent to the stepper motor controller 246, for energizing the stepper motor 84. The stepper motor 84 is energized and friction wheel 30 is pivoted until the slot 244 in opaque disk 220 is aligned with photosensing device 226, causing photosensing device 226 to provide a slot sense signal to start/stop circuit 250. The start/stop circuit 250 is reset by the slot sense signal, causing the stepper motor 84 to be stopped at that point. As noted above, the output from the device 226 occurs when the friction wheel 30 is aligned with the direction of fabric movement toward sewing machine 10. The purpose of the centering circuit comprising photosensing device 226 and start/stop circuit 250 is to insure that the friction wheel 30 remains in proper alignment when no fabric is present and does not try to guide a nonexistent fabric. The centering procedure described above is also performed when the system is powered up in order to insure that friction wheels 30, 32 are initially aligned with direction of fabric movement.

It will be understood that the circuit of FIG. 12 is only one example of a suitable feedback control circuit for the apparatus of the present invention. For example, the outputs of photosensors 184, 194 can be supplied to a computer which determines the required directions for guiding upper ply 14 and lower ply 16 and supplies energizing pulses through appropriate motor controllers to stepper motors 84 and 108.

Figure 5:
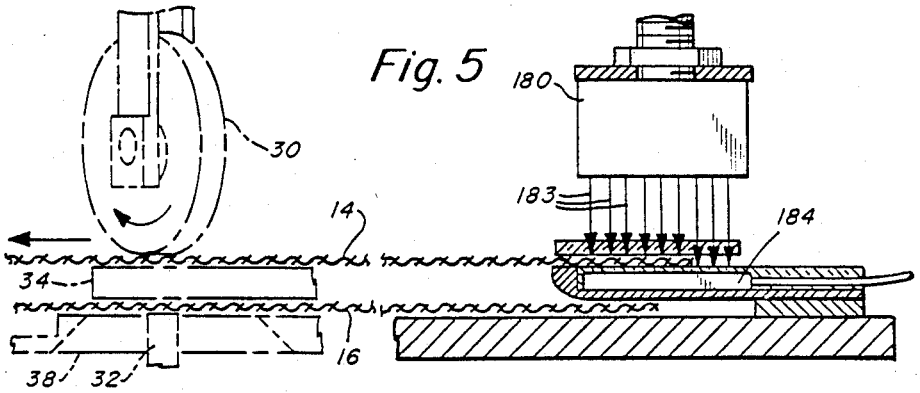
FIG. 5 is a schematic cross-sectional view of the alignment apparatus taken along the line 5—5 of FIG. 3 and illustrating alignment of the upper ply.
Figure 6:
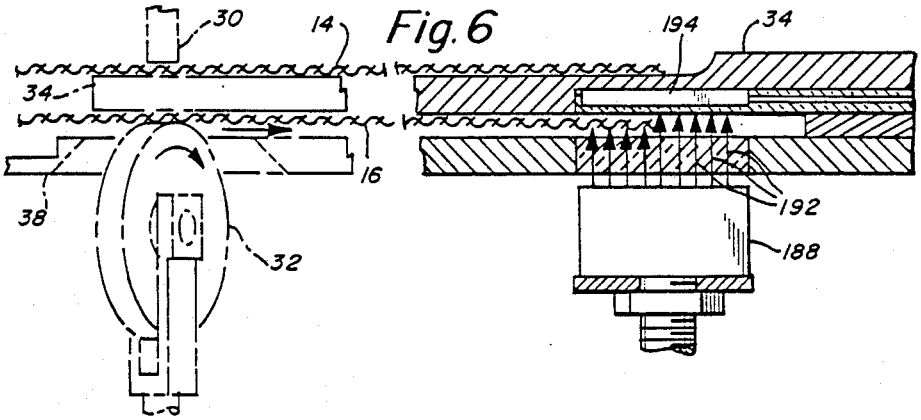
FIG. 6 is a schematic cross-sectional view of the alignment apparatus taken along the line 6—6 of FIG. 3 and illustrating alignment of the lower ply.

The operation of the alignment system of the invention is illustrated schematically in FIGS. 5 and 6. With reference to FIG. 5, the upper ply 14 is illustrated as being displaced to the right. As a result, a reduced portion of the light beam 183 from light source 180 reaches the photosensor 184. The photosensor 184 output is decreased below its normal voltage $V_o$, causing actuation of stepper motor 84 and pivoting of friction wheel 30 to the left. The leftwardly turned friction wheel 30 guides upper ply 14 toward the left, thereby gradually correcting its alignment. In FIG. 5, the lower ply 16 is correctly aligned, and friction wheel 32 is aligned parallel to the direction of fabric movement.

In FIG. 6, upper ply 14 is correctly aligned, and upper friction wheel 30 is aligned parallel to the direction of fabric movement toward the sewing machine 10. Lower ply 16 is displaced to the left so that more of the light beam 192 from light source 188 reaches photosensor 194. The photosensor 194 output is increased above its normal voltage $V_o$, causing activation of the stepper motor 108 and pivoting of the lower friction wheel 32 to the right. The rightwardly turned friction wheel 32 guides the lower ply 16 to the right toward the desired alignment line.

While there has been shown and described what is at present considered the preferred embodiments of the present invention, it will be obvious to those skilled in the art that various changes and modifications may be made therein without departing from the scope of the invention as defined by the appended claims.

What is claimed is:

1. Apparatus for aligning an upper ply and a lower ply moving in a prescribed direction prior to stitching in a sewing machine, said apparatus comprising:

upper sensing means for sensing displacement in a direction lateral to the prescribed direction of movement of an edge of the upper ply relative to a desired upper alignment line;

upper feedback means responsive to said upper sensing means for providing an upper error signal when said upper ply edge is displaced from said desired upper alignment line;

upper ply guide means responsive to said upper error signal for guiding said upper ply toward said desired upper alignment line as it is advanced toward the sewing machine, said upper ply guide mans comprising an upper friction wheel that rotates about a wheel axis parallel to the upper ply and that is continuously in contact with the upper ply during alignment, said upper friction wheel being normally aligned with the direction of upper ply movement and being pivoted to the left or right about a pivot axis that is perpendicular to the upper ply and intersects the wheel axis of said upper friction wheel, when said upper error signal indicates that the upper ply is displaced from the upper alignment line;

lower sensing means for sensing displacement in the direction lateral to the prescribed direction of movement of an edge of the lower ply relative to a desired lower alignment line;

lower feedback means responsive to said lower sensing means for providing a lower error signal when said lower ply edge is displaced from said desired lower alignment line; and lower ply guide means responsive to said lower error signal for guiding said lower ply toward said desired lower alignment line as it is advanced toward the sewing machine, said lower ply guide means comprising a lower friction wheel that rotates about a wheel axis parallel to the lower ply and that is continuously in contact with the lower ply during alignment, said lower friction wheel being normally aligned with the direction of lower ply movement and being pivoted to the left or right about a pivot axis that is perpendicular to the lower ply and intersects the wheel axis of said lower friction wheel, when said lower error signal indicates that the lower ply is displaced from the lower alignment line.

2. Alignment apparatus as defined in claim 1 wherein said desired upper alignment line and said desired lower alignment line coincide.

3. Alignment apparatus as defined in claim 1 wherein said upper sensing means comprises an upper light source mounted on one side of the upper ply and an upper photosensor mounted on the opposite side of the upper ply, said upper light source being positioned to direct a light beam across the edge of the upper ply at said upper photosensor.

4. Alignment apparatus as defined in claim 3 wherein said lower sensing means comprises a lower light source mounted on one side of the lower ply and a lower photosensor mounted on the opposite side of the lower ply, said lower light source being positioned to direct a light beam across the edge of the lower ply at the lower photosensor.

5. Alignment apparatus as defined in claim 4 wherein each photosensor comprises a linear array mounted to straddle the desired alignment line so that a prescribed portion of the photosensor is covered by the respective ply when the ply edge is on the desired alignment line and more or less of the photosensor is covered when the ply is displaced from the desired alignment line.

6. Alignment apparatus as defined in claim 1 wherein said upper ply guide means further comprises an upper guide surface positioned on the other side of the upper ply from said upper friction wheel, said upper friction wheel and said upper guide surface being positioned to grip the upper ply therebetween and upper drive means responsive to the upper error signal for pivoting said upper friction wheel about said perpendicular axis to as to guide the upper ply toward the desired alignment line.

7. Alignment apparatus as defined in claim 6 wherein said lower ply guide means further comprises a lower guide surface positioned on the other side of the lower ply from said lower friction wheel, said lower friction wheel and said lower guide surface being positioned to grip the lower ply therebetween and lower drive means responsive to the lower error signal for pivoting said lower friction wheel about said perpendicular axis so as to guide the lower ply toward the desired alignment line.

8. Alignment apparatus as defined in claim 7 wherein each drive means comprises a stepper motor responsive to the respective error signal and timing belt means for coupling said stepper motor to the respective friction wheel.

9. Alignment apparatus as defined in claim 7 further including an upper support arm for supporting said upper friction wheel above said upper ply, means coupling said upper support arm to a fixed table, a lower support arm for supporting said lower friction wheel below said lower ply and means coupling said lower support arm to a fixed table.

10. Alignment apparatus as defined in claim 9 further including upper retraction means for moving said upper friction wheel between an operating position in which said upper friction wheel bears against the upper ply and a retracted position for insertion or removal of the upper ply and lower retraction means for moving said lower friction wheel between an operating position in which said lower friction wheel bears against the lower ply and a retracted position for insertion or removal of the lower ply.

11. Alignment apparatus as defined in claim 9 further including upper adjustment means for adjusting the force between said upper friction wheel and said upper guide surface and lower adjustment means for adjusting the force between said lower friction wheel and said lower guide surface.

12. Alignment apparatus as defined in claim 9 further including upper centering means for aligning said upper friction wheel with the prescribed direction of movement when no upper ply is present and lower centering means for aligning said lower friction wheel with the prescribed direction of movement when no lower ply is present.

13. Apparatus for use with a sewing machine wherein a ply is moved in a prescribed direction toward the sewing machine, said apparatus comprising:

sensing means for sensing displacement in a direction lateral to the prescribed direction of movement of an edge of the ply relative to a desired alignment line;

feedback means responsive to said sensing means for providing an error signal when said ply edge is displaced from said desired alignment line; and ply guide means responsive to said error signal for guiding said ply toward said desired alignment line as it is advanced toward the sewing machine, said ply guide means comprising a friction wheel that rotates about a wheel axis parallel to the ply and that is continuously in contact with the ply during alignment, said friction wheel being normally aligned with the direction of ply movement and being pivoted to the left or right about an axis that is perpendicular to the ply and intersects the wheel axis of said friction wheel, when said error signal indicates that the ply is displaced from the alignment line.

14. Apparatus as defined in claim 13 wherein said sensing means comprises a light source mounted on one side of the ply and a photosensor mounted on the opposite side of the ply, said light source being positioned to direct a light beam across the edge of the ply at said photosensor.

15. Apparatus as defined in claim 14 wherein said photosensor comprises a linear photosensitive array mounted across the desired alignment line so that the amount of light from the light source which reaches the photosensor, and the corresponding output of the photosensor, vary with the displacement of the ply edge from the desired alignment line.

16. Apparatus as defined in claim 13 wherein said ply guide means further comprises a guide plate positioned on the other side of the ply from said friction wheel, said friction wheel and said guide plate being positioned to grip the ply therebetween and drive means responsive to the error signal for pivoting said friction wheel about said perpendicular axis.

17. Apparatus as defined in claim 16 wherein said drive means comprises a stepper motor responsive to the error signal and timing belt means for coupling said stepper motor to said friction wheel.

18. Apparatus as defined in claim 16 further including a support arm for supporting said friction wheel in contact with said ply and means coupling said support arm to a fixed table.

19. Apparatus as defined in claim 18 further including retraction means for moving said friction wheel between an operating position in which the friction wheel bears against the ply and a retracted position for insertion or removal of the ply.

20. Apparatus as defined in claim 16 further including adjustment means for adjusting the force between said friction wheel and said guide plate.

21. Apparatus as defined in claim 16 further including centering means for aligning said friction wheel with the prescribed direction of movement when no ply is present.

22. Alignment apparatus as defined in claim 21 wherein said centering means comprises means for energizing said drive means to pivot said friction wheel about said perpendicular axis when no ply is sensed in said apparatus and means for sensing the angular position of said friction wheel about said perpendicular axis and deenergizing said drive means when said friction wheel is aligned with said prescribed direction of movement.

23. Alignment apparatus as defined in claim 18 wherein said support arm includes spring means for biasing said friction wheel toward said guide plate.

24. Alignment apparatus as defined in claim 23 wherein said spring means comprises a pair of spaced-apart, parallel strips of spring material oriented generally parallel to said ply for supporting said friction wheel.

25. A method for aligning an upper ply and a lower ply moving in a prescribed direction prior to stitching in a sewing machine, said method comprising the steps of:

sensing displacement of an edge of the upper ply relative to a desired upper alignment line and providing an upper error signal when said upper ply edge is displaced from said desired upper alignment line;

guiding said upper ply edge toward said desired upper alignment line in response to said upper error signal by biasing an upper friction wheel continuously against the upper ply during alignment and pivoting the upper friction wheel to the left or right of a normal position aligned with the direction of upper ply movement, said upper friction wheel being pivoted about an axis that is perpendicular to said upper ply and intersects the wheel axis of said friction wheel;

sensing displacement of an edge of the lower ply relative to a desired lower alignment line and providing a lower error signal when said lower ply edge is displaced from said desired lower alignment line; and guiding said lower ply edge toward said desired lower alignment line in response to said lower error signal by biasing a lower friction wheel continuously against the lower ply during alignment and pivoting the lower friction wheel to the left or right of a normal position aligned with the direction of lower ply movement, said lower friction wheel being pivoted about an axis that is perpendicular to said lower ply and intersects the wheel axis of said friction wheel.

26. An alignment method as defined in claim 25 wherein the steps of sensing displacement of the edges of the upper and lower plies each include the step of sensing displacement by positioning a photosensitive device adjacent the edge of the respective ply and directing a light source across the edge of the respective ply at the photosensor so that the photosensor output is varied in response to displacement of the edge of the respective ply from the desired alignment line.

27. A method for aligning a fabric ply moving in a prescribed direction prior to stitching in a sewing machine, said method comprising the steps of:

sensing displacement of an edge of the ply relative to a desired alignment line and providing an error signal when the ply edge is displaced from the desired alignment line; and guiding the ply edge toward the desired alignment line in response to the error signal by biasing a friction wheel continuously against the ply during alignment and pivoting the friction wheel to the left or right of a normal position aligned with the direction of ply movement, said friction wheel being pivoted about an axis perpendicular to the ply and intersecting the rotation axis of said friction wheel.

* * * * *